United States Patent [19]

Demetrio et al.

[11] 3,955,064

[45] May 4, 1976

[54] HAIR STYLING IRON HAVING INTERCHANGEABLE HEATING TIPS

[75] Inventors: Concetto Bruno Demetrio; Martin Apelbaum, both of New York, N.Y.; Robert C. Tischio, Great Notch, N.J.

[73] Assignee: Le Salon Bruno Demetrio Ltd., New York, N.Y.

[22] Filed: May 23, 1974

[21] Appl. No.: 472,662

[52] U.S. Cl. ..... 219/225; 132/7; 132/32 R; 132/37 R; 219/238; 219/533; 219/541

[51] Int. Cl.[2] ..... H05B 1/00; A45D 1/04

[58] Field of Search ..... 132/7, 9, 117, 118, 132/112, 31 R, 32 R, 33 R, 34, 36 R, 37 R, 37 A; 219/222–226, 221, 227–228, 230, 231, 236–241, 541, 533; 38/69, 71; 223/35, 36

[56] References Cited

UNITED STATES PATENTS

| | | | |
|---|---|---|---|
| 364,956 | 6/1887 | Posner | 132/37 R |
| 536,802 | 4/1895 | Harris | 132/32 R |
| 1,117,021 | 11/1914 | Frey | 132/37 R |
| 1,284,792 | 11/1918 | Schwartz | 132/37 R X |
| 1,588,241 | 6/1926 | Leland | 132/32 R |
| 2,258,844 | 10/1941 | Brown et al. | 132/31 R |
| 2,648,757 | 8/1953 | Harper | 219/241 UX |
| 3,102,941 | 9/1963 | Pope | 132/37 R |
| 3,120,598 | 2/1964 | Westerback et al. | 219/238 X |
| 3,220,421 | 11/1965 | Van Droogenbroek et al. | 219/222 UX |
| 3,610,258 | 10/1971 | Van Droogenbroeck | 219/222 UX |

FOREIGN PATENTS OR APPLICATIONS

| | | | |
|---|---|---|---|
| 1,289,545 | 2/1961 | France | 219/240 |
| 1,379,083 | 10/1964 | France | 219/225 |
| 364,668 | 11/1922 | Germany | 219/228 |

*Primary Examiner*—A. Bartis
*Attorney, Agent, or Firm*—Kenyon & Kenyon Reilly Carr & Chapin

[57] ABSTRACT

An elongated handle having a square cross-section is adapted at one end to receive a swivel electrical power supply means and at the other end to receive a detachable hollow, metal housing which encloses a heating element. The housing is elongated about its longitudinal axis and is formed with a plurality of flat side surface portions disposed angularly with respect to each other and joined at parallel edges which are slightly rounded for imparting a temporary bend to wet hairs held over the rounded edges under tension. A flipper arm type hair holding means is pivotably mounted to the handle and has a blade portion which overlies the upper flat side surface of the housing for sandwiching strands of hair therebetween. The housing and handle are coupled together through quick-release, locking means operable with the same hand with which the handle is held by simply depressing a release button mounted on the handle permitting an urging means to disconnect the housing from the handle without the necessity of the operator to use the other hand to touch or grab the hot housing. Means are provided for applying oil vapor to the held hair through slots on the upper flat side surface of the housing.

15 Claims, 9 Drawing Figures

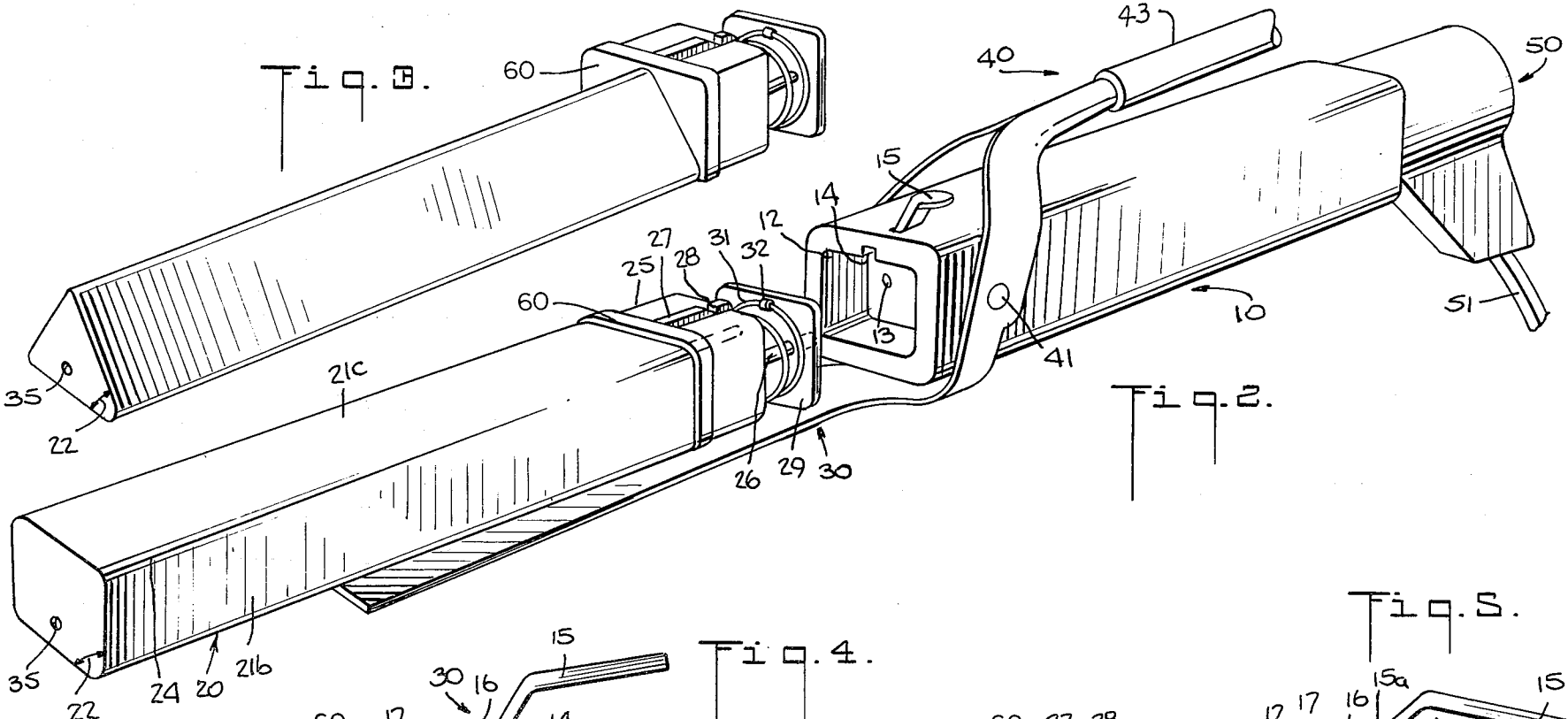
Fig. 2.
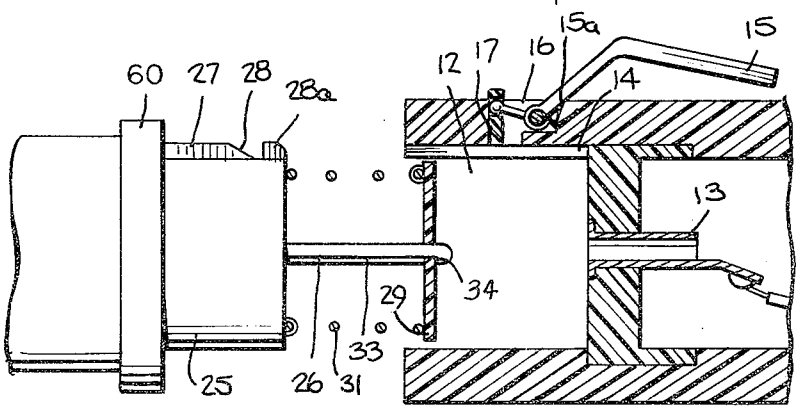
Fig. 5.
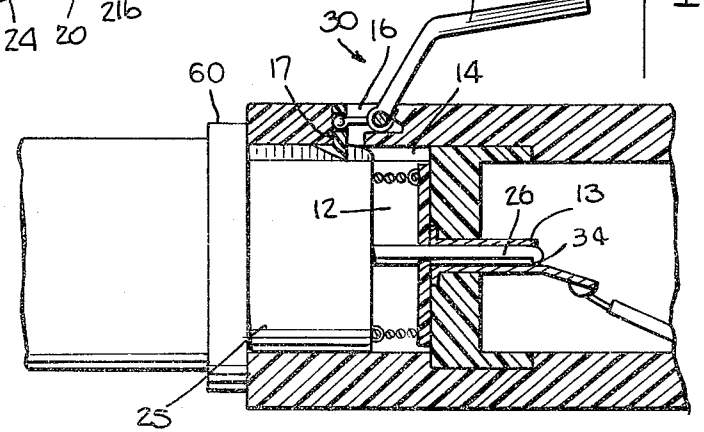
Fig. 4.
Fig. 3.

HAIR STYLING IRON HAVING INTERCHANGEABLE HEATING TIPS

BACKGROUND OF THE INVENTION

1. Field of the Invention

The invention relates generally to improvements in hand held, electrically heated, hair curling irons and particularly to the structure of the heated tip, to the means for quickly detaching the tip from the handle and to the means of clamping the hair against the heated tip, as well as to other improvements.

2. Description Of The Prior Art

Hair stylists are continuously looking to create new and unusual hair styles.

A need has developed for a hair styling iron which will impart an angular appearance to the outer two or three inches of a head of hair so that the hair may then be confused (i.e., jostled and rearranged) by the stylist to create a new hair style. The iron should have a detachable tip and a hair clamp means permanently fixed to the handle of the iron.

Various conventional electric hair curling irons are on the market. One type has a non-detachable, round, heated, metal tip having a hair clamp means pivotably mounted on the tip. Such an iron is obviously unsuitable since it is only adapted to curl hair to form waves and is incapable of making a sharp bend to the outer 2 inches of the hair needed to impart an angular appearance to the head. Further, such an iron has the disadvantage of being incapable of using substitute tips of various sizes for making tight or loose curls as needed to create the hair style of the operator's choice.

Another conventional electric hair curling iron comes in a kit form in which is provided several detachable heated tips of various sizes any one of which may be connected with a single handle, also provided. While this iron has the flexibility of numerous substitutable tips, this iron is very costly since it provides a biased hair clamp means pivotably connected to the metal tip and, since numerous tips are provided, each tip carries its own biased hair clamp. Further, all the tips are round and can only curl the hair, not angularly bend it. Also the tip, though detachable, is held within the handle by such high frictional forces that to disconnect the tip from the handle it is necessary for the operator to hold the handle with one hand and grab the tip with the other hand and pull the two units apart with considerable force before they will disengage. Obviously some protective covering for the hand is necessary before the operator can grab the tip if the tip has been recently used and is hot.

Applicants' invention fills the aforesaid need by providing a tip which has flat sides positioned angularly with respect to one another and provided with only slightly rounded edges. Further applicants' iron provides improvements to overcome the shortcomings of prior conventional styling irons, as for example, by pivotably mounting the hair holding means to the handle and by providing a single-handed, quick-release means for disconnecting the tip from the handle. Other improvements are also provided.

SUMMARY OF THE INVENTION

The electric powered hair styling iron of the present invention is held in one hand by a handle and is further provided with a detachable tip which houses a heating element, the tip being a hollow elongated metal housing formed with at least one but preferably a plurality of integral flat side surfaces disposed angularly with respect to each other and joined at edges which are only slightly rounded and are parallel to each other, the interior angles formed at the edges not exceeding substantially right angles. A hair holding means is pivotably connected to the handle, has a flat, elongated blade portion overlying the upwardly facing flat side surface portion of the tip and a flipper arm portion generally underlying the opposite downwardly facing side of the handle. When the flipper arm portion is squeezed toward the handle, it forces the blade portion tightly against the flat upper side surface of the tip for holding strands of hair therebetween. The tip and handle are provided with quickrelease means for disconnecting the detachable tip from the handle operable by the operator with the same hand which is used to hold the handle.

Wet strands of hair are firmly sandwiched between the heated flat side surface and the overlying blade of the holding means and then the iron is rotated about 90° while gently applying tension to the held hairs by gently pulling the iron away from the head. That position is held until the held hairs are dried. Upon release of the flipper arm portion, the hairs are released and are observed to have been bent in the area disposed over the edges of the heated tip presenting a pleasing angular appearance to the hair for use in creating a hair style to the stylist's choice.

The objects of the present invention are as follows:

1. To provide a means for imparting an angular appearance to the hair without breaking the hair by temporarily rearranging the hair molecules.

2. To provide a single means for holding the hair which can be used with a variety of detachable heated tips.

3. To provide a means for quickly disconnecting a detachable heated tip from a handle by using only one hand, that is without the necessity to grab the heated tip with the other hand and physically pull it from engagement in the handle.

4. To provide a means for easily rotating the handle within the hand.

Other objects will be apparent from a reading of the description of the drawings and preferred embodiments which follows.

DESCRIPTION OF THE DRAWINGS

FIG. 2. A perspective view of the underside of the hair styling iron of FIG. 1 showing the tip disengaged from the handle.

FIG. 3. A perspective view of an alternate embodiment of the detachable tip having a generally triangular cross-sectional configuration.

FIG. 4. A partial sectional view of the single-handed, quick-release lock means showing the tip and handle engaged.

FIG. 9. A view similar to FIG. 8 showing the dried hairs having been released and having a temporary bend in the area which overlay the edge of the flat heated surface.

DESCRIPTION OF THE PREFERRED EMBODIMENT

Figures 1, 5, 6, 7, 8:
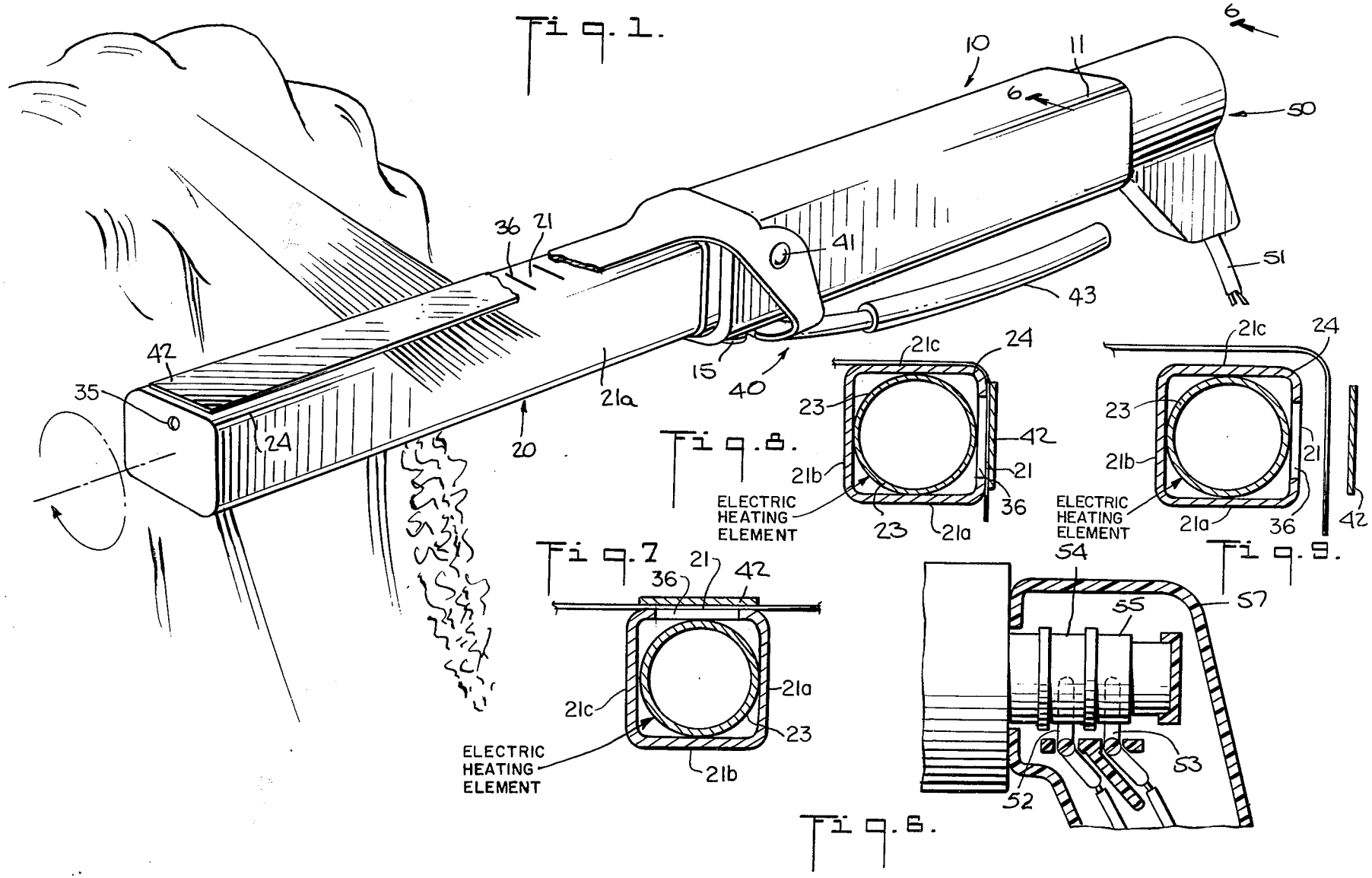
FIG. 1. A perspective view of the hair styling iron of the present invention holding strands of hair to be bent over a detachable tip which is generally square in cross-section.
FIG. 5. A view similar to FIG. 4 showing the tip and handle disengaged.
FIG. 6. A partial sectional view of the electrical swivel connection at one end of the handle which permits 360° of handle motion relative to the power supply means without tangling the supply cord or breaking electrical contact.
FIG. 7. A partial section of the tip of the hair styling iron of FIG. 1 showing the outer three inches of strands of wet hair sandwiched between the heated flat upper side surface of the tip and the overlying blade portion of the hair holding means.
FIG. 8. A view similar to FIG. 7 showing the iron rotated about 90° and the held hairs being gently pulled disposing the hairs over the slightly rounded side edge of the flat heated surface.

Referring to FIGS. 1 and 2 there is shown generally the hair styling iron of the present invention including a handle 10, a detachable tip 20, a single-handed, quick-release locking means 30, a pivotably mounted hair holding means 40 and electrical supply means 50.

The handle 10 is generally rectangular or square-shaped formed with a plurality of flat sides and elongated along its longitudinal axis. The square cross-sectional shape is smoothed somewhat by providing rounded edges 11 at the corners. As thus formed, the handle fits the hand of the operator quite nicely and the rounded corners permit the operator to easily rotate the iron while holding it in one hand. This action is done by simply applying upward thumb pressure to one of the corners while squeezing the flipper arm portion of the hair clamp means and holding the handle 10 in the same hand to thereby rotate the handle in the hand. The handle is thus easy to grab and manipulate. One end of the handle is adapted to receive and electrically connect to the detachable tip shown generally as 20 in FIG. 1. To the other end of the handle is connected a swivel electrical connection and power supply means shown generally as 50 in FIG. 1. Handle 10 is preferably made of plastic.

As best seen in FIGS. 2–5, the structure of the detachable tip and the manner of connecting the detachable tip to the handle is clearly shown. One end of handle 10 is formed with a square-shaped recess 12 and a pair of electrical coupling members 13 mounted in the base wall of recess 12. Recess 12 is formed with a groove 14 in one side wall. Push button 15 is a lever arm release means pivotably mounted in aperture 16 of handle 10 and is formed with tongue or lip 17 pivotably mounted to the end of lever 15. Tongue 17 is capable of extending into groove 14 for cooperation with guide member 27, as more fully described below.

The detachable tip 20 is a hollow metal housing or casing which is elongated about its longitudinal axis and has a flat closed front end wall. The housing, or exterior shell, is formed with at least one but preferably a plurality of integral, straight, flat side surface portions 21*a* and 21*b* having parallel edges and positioned angularly with respect to the upper flat surface 21 and the lower flat surface 21*c*. The exterior shape of the tip 20 thus formed is preferably rectangular as shown in FIG. 2. If each of the side surfaces 21, 21*a* and 21*b* are also positioned angularly with respect to each other, the exterior shape of the housing may also be triangular as shown in FIG. 3 as an alternative embodiment. Other shapes presenting flat sides angularly disposed relative to each other are also possible. The angular shape of the external tubular shell or housing 20 of the detachable tip is important in the styling of the hair, as more fully described below. Preferably the interior angles 22 at each corner formed by the sides 21, 21*a*, 21and 21*c* are each substantially 90° or less. If the interior angle substantially exceeds 90°, the bend imparted to the hair becomes less distinct. As shown in FIGS. 2 and 3, the interior angles 22 are preferably equal to each other, approximately 90° as shown in FIG. 2, or 60° as shown in FIG. 3. The exterior shape of the tip of FIG. 2 is rectangular and the tip shown in FIG. 3 is that of an equilateral triangle. Preferably, the parallel edges 24 which join the adjacent side surfaces of tip 20 are very slightly rounded which is important to permit bending the hair without breaking it. As more clearly seen in FIG. 7, a heating element 23 is disposed within detachable tip 20 for heating up sides 21, 21*a*, 21*b* and 21*c*.

Handle 10 and detachable tip 20 are coupled together by a single-handed, quick-disconnect means shown generally as 30 in FIG. 4. The base end of tip 20 is closed with a rectangularshaped end cap 25 which is of a dimension to enter and be received by recess 12. Cap 25 carries a pair of male electrical connectors 26 which are secured and electrically connected to the heating element 23 within tip 20 and are designed to be received within electrical couplings 13 formed at the base of recess 12. Cap 25 also includes a guide member 27 which is received within groove 14. Guide 27 is formed with groove or notch 28 to cooperate with tongue 17 of release means 15. Groove 28 and tongue 17 form a lock means to hold tip 20 within handle 10. Base plate 29 is slidably mounted on male connectors 26 and is biased outwardly by compression spring 31. The compression spring is fixed to the base plate 29 by clamp 32. The outward movement of base plate 29 is limited by stop shoulders 34 of connectors 26 abutting against the outside face of base plate 29 riding in grooves 33.

As shown in FIGS. 4–5, when tip 20 is inserted into handle 10, cap 25 is received by recess 12. Guide 27 slides within groove 14 and connectors 26 are thereby aligned with and received within connectors 13. Base plate 29 contacts the base wall of recess 12 and, as the tip and handle are brought together, spring 31 is compressed by plate 29 until groove 28 is aligned with tongue 17 to snap in and lock tip 20 in recess 12 and shoulder 60 of tip 20 fits snugly against the end wall of handle 10. Push button 15 is spring loaded by torsion spring 15*a* to permit tongue 17 to slide outwardly when engaged by the forward edge 28*a* of guide 27. To release tip 20 it is only necessary to depress push button or lever arm 15 disengaging tongue 17 from detent 28 and spring 31 is sufficiently strong to overcome the frcition of electrical connectors 26 being held within coupling members 13 to thereby forcibly disengage the tip from the handle.

The detachable tip 20 is further provided with an aperture 35 in the closed front end wall for introducing oil into the inside of the housing. The oil is vaporized by the heating element 23 and the vapor is released through a plurality of slots 36 disposed on the top flat surface of the tip 20 for lubricating and conditioning the hair which is held by hair clamp means 40, as more fully described below.

The handle 10 is equipped with a flipper arm type hair holding means shown generally as 40 in FIG. 1. The hair holding means 40 is pviotably mounted to the handle at pivot point 41. The hair holding means is an S-shaped mechanism which has an elongated flat blade portion 42 which overlies the upper flat side surface portion of the detachable tip 20 and also covers the oil vapor slots 36 therein. The blade portion 42 is elongated to cooperate with the upper flat surface 21 of the elongated tip as a means for holding or sandwiching strands of hair therebetween. The other end of the hair holding means has a slightly bowed flipper arm portion 43 formed integrally with portion 42 and extending generally under the downwardly facing side of handle 10 but displaced a short distance therefrom so that it is within easy reach of the operator's fingers, using the same hand with which he holds the handle. The referenced downwardly facing side of handle 10 is opposite upper flat surface 21. When flipper arm portion 43 is squeezed and pulled toward handle 10, blade portion 42 is simultaneously urged tightly against the upper flat surface 21 of the tip to provide a means for clamping the hair which is to be styled by the iron. One advantage of having the hair clamp means pivotably attached to the handle 10 rather than to the detachable tip 20, as was done in the prior art, is that when the detachable tip is disconnected the hair clamp lever arm is retained on the handle. Thus, a number of different detachable tips can be provided without the necessity of providing each of them with a spring loaded hair holding means, resulting in great savings in cost and materials.

The quick disconnect means of the present invention provides the advantage of being single-handed, i.e., being able to shift from one tip to another by simply releasing the hair clamp means 40 and then manually pressing release button 15 permitting the tip to self-separate, i.e., be "popped out" of handle 10 by compression spring 31. A new tip is quickly and easily snapped into place. This removal and replacement action can be done without the operator having to touch the first hot tip with his other hand in order to disengage it from handle 10.

The rear end of handle 10 is provided with a swiveled electrical connection shown generally as 50 in FIG. 1. As more clearly seen in FIG. 6, electrical cord 51 terminates in contact arms 52, 53 which are in continuous contact with commutator rings 54, 55 which are electrically insulated from each other and which transmit electrical power to the handle and thence to heating element 23 in tip 20 through coupling members 13 and male electrical connector pins 26. The exposed wires of swivel 50 are enclosed in plastic cover 57. The arrangement of the swivel electrical connection described above enables the styling iron to be rotated 360° by the operator without tangling electrical cord 51 since contact points 52, 53 remain stationary but are in constant contact with commutator rings 54, 55 regardless of the rotative position of the commutator rings.

The hair styling iron of the present invention is used in the following manner, as is most clearly seen in FIGS. 1, 7, 8 and 9. The operator pushes flipper arm 43 away from handle 10 with his finger which lifts blade portions 42 away from side 21 permitting the operator to place a lock of hair on top of the upper flat side 21 of tip 20 over the oil vapor slots. The filpper arm 43 is then squeezed and blade 42 firmly holds the lock of hair in place as shown in FIG. 7. The operator then rotates the styling iron approximately 90° and pulls gently as shown in FIG. 8 while continuing to squeeze flipper arm 43. This position and pressure is maintained for a short period of time and the lock of hair is then released as seen in FIG. 9 by releasing flipper arm 43. When the hair is released it is seen that the hair is bent in the area that was over the slightly rounded corner 24. This step is repeated, as desired by the operator, until sufficient hairs are bent so that the operator can then create the desired new hair style.

Thus, the new result obtained by the present invention is simply that rather than curling the hair, as was well known in the prior art, the hair is bent giving an angular or stair-step appearance which is useful in creating a new and pleasing hair style.

As is well known in the hair dressing field, a strand of hair is made up of three layers namely, the cuticle, cortex and medula. The cuticle is the outside layer. The cortex is the middle layer. The central part of the hair is called the medula. In hair styling, the primary objective is to relocate the molecules of the three layers of hair in a desired position and then to dry the hair to temporarily fix the position of the molecules in the hair until the hair is again wetted. In the present invention, the operator starts with wet hair with molecules in their natural position. When the hair is squeezed under the clamp in the iron and the iron is turned approximately 90° and pulled gently, the molecules of hair open and expand in the area over the slightly rounded edge 24 between the flat sides of the iron and are then dried in their expanded position to temporarily fix the location of the molecules. Thus, the angular shape of the detachable tip 20 is imparted to the locks of hair to give an angular or bent or stair-step appearance to the locks of hair, neither purposefully obtained nor considered desirable prior to applicants' invention hereof. At the same time that the drying action takes place, the vaporized oil is applied to the hair to condition and lubricate it so that it does not completely dry out or become brittle, especially in the areas bent over edges 24. Unlike in the curling irons of the prior art, with the styling iron of the present invention it is only necessary or desirable to work with about a 2 inch length portion of the hair and to impart the characteristic bend to the outer extremity of the hair. Indeed, the whole idea of the styling iron of the present invention is to avoid the formation of a wave in the hair as was known in the prior art, but rather to impart a temporary bend to the ends of the hairs which can be confused by the hair stylist to his liking to create a new style based on an angular appearance.

Thus, it is important that the edges joining adjacent flat sides of the iron are slightly rounded. This blunting of the sharp edge is necessary to be sure that the hair is bent and not broken by overstressing the hair in the location of the angles when it is gently pulled as described above. If the radius used to round the edges is too large, the bend imparted to the hair is not distinct. If the radius is too small, there is risk of overstress to the hair at the point of bending and possibly the hair may break. If the flat sides are one inch in width, a radius of less than about 10 percent of the width of the flat side is satisfactory.

Only a single flat surface disposed under the hair holding means and bordered by slightly rounded edges is needed to practice the present invention. However, a plurality of flat sides is preferred as this makes the angular appearance of the hair more distinct in that the hair is pressed against a flat surface on either side of the slightly rounded edge in such embodiments. The triangular tip of FIG. 3 produces a more pronounced angular appearance than the rectangular tip of FIG. 2.

FIGS. 2 and 3 show triangular and rectangular square shaped tips. Of course, circular type detachable tips for curling irons are well known in the prior art. Such circular tips can be used with the handle, hair holding means and singlehanded, quick-disconnect means of the present invention to provide a hair styling iron which will curl hair as is well known. Indeed, the applicants contemplate providing a single kit having a handle and hair clamp with three or more detachable tips, i.e., a square, a triangle and a round tip of various sizes, to thus provide complete flexibility in hair styling.

What is claimed is:

1. In a hand-held hair styling iron including electrical power supply means, a handle, a tip detachable from said handle and having a heating element therein heated by the electrical power supply means, and means pivotally mounted to said handle for holding strands of the hair against the heated tip, the improvement comprising the tip being a hollow metal housing elongated about its longitudinal axis and formed with at least one flat side surface portion coextensive with the length of said tip, the one said flat side surface portion being disposed under the holding means which is adapted for sandwiching strands of hair therebetween, the other of the side surface portions of the housing being formed integral with the one flat side surface portion and being joined therewith at side edges, the interior angles formed therebetween not exceeding substantially right angles, the side edges of the one flat side surface portion being slightly rounded whereby when wetted strands of hair are held over at least one of said side edges of the heated tip under slight tension, the hairs are dried and a temporary angular bend is imparted to the dried strands of hair, said handle having means at one end to detachably receive and support said tip and electrically connect the heating element associated with the detachable tip to the electrical power supply means, said means to detachably receive and support and electrically connect including release means pivotally mounted on said handle, releasable lock means associated with said detachable tip and handle for holding said tip securely to said handle such that said electrical connection is made, said release means cooperable with the lock means to engage and disengage the same upon pivotal operation thereof by the operator using the same hand in which the handle is held.

2. The iron of claim 1 wherein the side edges are parallel.

3. The iron of claim 2 wherein the other of the side surface portions include a plurality of additional flat side surface portions angularly disposed relative to the one flat side surface portion.

4. The iron of claim 3 wherein the transverse cross-sectional shape of the metal housing is generally rectangular.

5. The iron of claim 3 wherein the additional flat side surface portions are also disposed angularly with respect to each other.

6. The iron of claim 5 wherein the transverse cross-sectional shape of the metal housing is generally triangular.

7. The iron of claim 3 wherein said heating element only partially fills said tip whereby a space is created between said heating element and said housing, the iron further comprising the housing having a flat closed front end wall and an aperture therein for receiving oil drops into said space, the flat side surface portion disposed under the holding means being formed with a plurality of vapor slots communicating with said space for emitting oil vapor to condition the hair.

8. The iron of claim 1 wherein the improvement further comprises:

said pivoted hair holding means having an elongated flat blade portion integrally formed with a flipper arm portion, the blade portion overlying the one said flat side surface portion of the detachable tip and cooperable therewith to hold strands of hair therebetween, said flipper arm portion coextending, at least in part, with said handle.

9. The iron of claim 8 wherein said flipper arm portion is disposed generally under the handle but displaced a short distance therefrom, whereby squeezing the flipper arm portion toward the handle moves the blade portion against the one said flat side surface portion of the tip.

10. The iron of claim 9 wherein the hair holding means is generally S-shaped.

11. The iron of claim 1 further comprising urging means mounted between said tip and said handle such that said urging means is biased to exert a separating force between said tip and said handle when said tip is held to said handle by said lock means, whereby upon actuation of the release means to disengage the lock means the urging means has sufficient force to overcome the electrical connection between the tip and the handle to forcibly detach the tip from the handle.

12. The iron of claim 11 wherein the release means is a push button, the lock means is a cooperable tongue, pivotally connected to said push-button, and groove positioned on said tip, said tongue engaging or disengaging said groove in response to pivotal movement of said button and the urging means is a compression spring.

13. The iron of claim 12 wherein the handle, elongated about a longitudinal axis, has one end formed with a plurality of flat sides having a generally rectangular cross-section, the edges between adjacent flat sides being rounded to provide smooth corners, the other end having a swivel connector means mounted in circuit between said electrical power supply means and said electrical connection at the point of attachment between said tip and said handle.

14. In a hand-held hair styling iron having electrical power supply means, a handle, an elongated housing detachable from said handle and having a heating element therein heated by the electrical power supply means, and means for holding strands of hair against the heated housing, said handle having means at one end to detachably receive and support said housing and electrically connect the heating element in said housing to the electrical power supply means the improvement comprising:

release means pivotally mounted on the handle, lock means associated with the detachable housing and the handle, said lock means holding said housing to said handle in an electrical and mechanical, operative assembled relationship, the release means cooperable with the lock means to engage and disengage the same upon pivotal operation thereof by the operator using the same hand in which the handle is held, and urging means, mounted between said housing and said handle, such that said urging means is biased to exert a separating force between said tip and said handle when said tip is held to said handle by said lock means, for self-separating the housing from the handle upon manual operation of the release means to disengage the lock means, and said hair holding means being pivotally mounted to the handle having an elongated flat blade portion overlying the housing and cooperable therewith to hold strands of hair therebetween and a flipper arm portion formed integral with the blade portion and disposed generally under the handle but displaced a short distance therefrom.

15. A hair styling iron comprising electrical power supply means, a handle, a detachable hollow metal housing elongated about its longitudinal axis and formed with at lease one flat side surface portion, the others of the side surface portions of the housing being formed integral with the one flat side surface portion and being joined therewith at side edges, the interior angles formed therebetween not exceeding substantially right angles, the side edges of the one flat side surface portion being slightly rounded, a heating element mounted in the housing, the handle having means at one end to detachably receive and support said housing and electrically connect to said heating element and at the other end having a swivel connector means mounted in circuit between said electrical power supply means and the electrical connection at said one end, release means pivotally mounted on the handle, lock means associated with the detachable housing and the handle, said lock means holding said housing to said handle in an electrical and mechanical, operative assembled relationship, the release means cooperable with the lock means to engage and disengage the same upon pivotal operation thereof by the operator using the same hand in which the handle is held, and urging means mounted between said housing and said handle, such that said urging means is biased to exert a separating force between said tip and said handle when said tip is held to said handle by said lock means, for self-separating the housing from the handle upon manual operation of the release means to disengage the lock means, and hair holding means pivotally mounted to the handle and having an elongated flat blade portion overlying the one said flat side surface portion and cooperable therewith to hold strands of hair therebetween and a flipper arm portion formed integral therewith and disposed generally under the handle but displaced a short distance therefrom.

* * * * *

UNITED STATES PATENT AND TRADEMARK OFFICE

CERTIFICATE OF CORRECTION

PATENT NO. : 3,955,064

DATED : May 4, 1976

INVENTOR(S) Concetto Bruno Demetrio, et al

It is certified that error appears in the above-identified patent and that said Letters Patent are hereby corrected as shown below:

| | | |
|---|---|---|
| Col. 1, line 55 | - | insert "or" between the words "one (or) another" |
| Col. 2, line 15 | - | hyphenate "quickrelease" |
| Col. 4, line 3 | - | now reads "21, 21a, 21and 21c" should read "21, 21a, 21b and 21c" |
| Col. 4, line 20 | - | hyphenate "rectangularshaped" |
| Col. 4, line 53 | - | "frcition" should read "friction" |
| Col. 4, line 66 | - | "pviotably" should read "pivotably" |
| Col. 5, line 58 | - | "portions" should read "portion" |
| Col. 5, line 60 | - | "filpper" should read "flipper" |
| Col. 7, line 31 | - | there should be a new sub-paragraph starting with "the side edges..." |
| Col. 9, line 23 | - | now reads "lease", should read "least" |

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*